United States Patent [19]

Huxley

[11] 3,942,015

[45] Mar. 2, 1976

[54] ROTATING-ANODE X-RAY TUBE

[75] Inventor: Hugh Esmor Huxley, Cambridge, England

[73] Assignee: National Research Development Corporation, London, England

[22] Filed: Oct. 24, 1974

[21] Appl. No.: 517,826

[30] Foreign Application Priority Data

Nov. 1, 1973 United Kingdom ..... 50841/73

[52] U.S. Cl. ..... 250/406; 313/60

[51] Int. Cl.[2] ..... H01J 35/04

[58] Field of Search ..... 250/401, 402, 406; 313/60

[56] References Cited

UNITED STATES PATENTS 3,149,257 9/1964 Wintermute ..... 250/406

*Primary Examiner*—Craig E. Church

*Attorney, Agent, or Firm*—Cushman, Darby & Cushman

[57] ABSTRACT

A rotating anode for an X-ray tube is constructed with a broad rim on to which the radiation - exciting electron beam is focused from a direction perpendicular to the axis of rotation. In order to distribute the thermal loading over the surface of the rim a transverse scanning motion is applied to the electron beam. Viewing the source conventionally from a direction nearly parallel to the axis of rotation the scanning spot is required to appear stationary and this is achieved by forming the surface of the anode rim in a uniform pattern of transverse channels. The scanning waveform must conform generally to the cross-section of the channels and the frequency and phase of the scanning motion must bear a defined relationship to the rate of rotation of the channel pattern.

6 Claims, 3 Drawing Figures

ROTATING-ANODE X-RAY TUBE

This invention relates to rotating-anode X-ray tubes of the type in which in use an electron beam is focused to an intense spot on the cylindrical surface of the anode and the tube is constructed so that the X-rays thereby excited may be extracted in a direction nearly parallel to the axis of rotation.

It is usually required that the X-ray source constituted by the spot should appear as small as possible when viewed in the direction in which the X-rays are extracted, so that the apparent intensity of the source will be as high as possible for a given power of electron beam. When working at very high powers, however, a limitation is imposed on the minimum actual area of the spot by considerations of thermal loading at the anode surface. The usual compromise is to focus the beam to a spot of narrow rectangular shape and to view the spot along its length obliquely to the surface, at an angle of 4° or 5°, so that it appears approximately square. Precautions are taken to hold the focused spot stationary so that its apparent intensity shall not be reduced.

Rotation of the anode serves to limit the rise in surface temperature by distributing the electron beam energy over a track extending around the anode rim and hence permits the use of the higher electron beam power for a given spot size than would be the case if a static anode were used. The maximum advantage in this respect is obtained by using a large anode diameter and a high rate of rotation but a limit on these factors is imposed by the possibility of dangerous mechanical stresses arising in the material of the anode.

It is an object of the present invention to provide an arrangement whereby, for an anode of given diameter and rate of rotation, the maximum power rating of an X-ray tube of the type specified may be increased as compared with conventional arrangements.

According to the present invention there is provided a rotating-anode X-ray tube of the type specified, in which the anode is in the form of a wheel having a rim of uniformly serrated profile, the width of the rim being large relative to the depth of the serrations and to the dimensions of the focused spot and the arrangement being such that the electron beam may be deflected so as to cause the spot to scan across the anode rim.

The invention further provides an X-ray generator comprising a rotating-anode X-ray tube as specified in the preceding paragraph, and means for cyclically deflecting the electron beam so that the focused spot is caused to scan to and fro across the anode rim, the frequency, phase and waveform of the scan being such that the spot will appear substantially stationary when viewed in a direction lying in a plane passing through the axis of rotation of the anode and making with said axis an angle whose tangent is equal to the ratio of the depth of each serration to the length of the scan across the rim.

The effect of superimposing a lateral motion of the electron beam on the rotary motion of the anode is to provide a comparatively uniform distribution of electron-beam energy over the surface of the anode rim and thereby to increase the permissible power level. It will be seen that the synchronism between the rotation of the anode and the scanning movement of the focused spot which is necessary for the spot to appear stationary will be achieved if the following conditions are satisfied:

a. The frequency of scanning must be such that the anode rotates through one pitch of the rim serration profile during one scanning period; thus, scanning frequency = number of serrations X rotational frequency.

b. The phase of the scanning pattern must be such that at that end of a sweep more remote from the viewing position the spot lies in the trough of a particular serration and at the other end of the sweep it lies on the crest of the same serration.

c. The scanning waveform must generally comply with the profile of the serrations so that the spot moves to and fro over the inclined faces of the serrations without any discontinuity.

An embodiment of the invention will be described by way of example with reference to the accompanying drawings in which.

Figure 1:
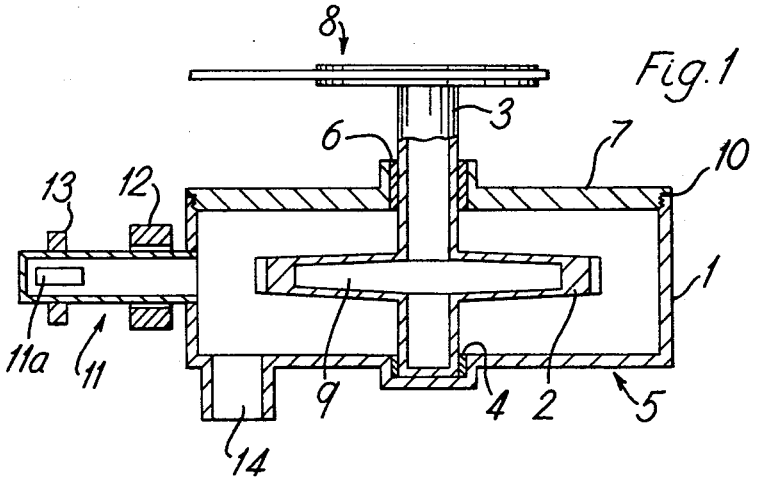
FIG. 1 is a diagrammatic representation of an X-ray tube showing the external features which pertain to the invention.

Referring to FIG. 1 a vacuum-tight metal envelope 1 of generally cylindrical form houses a rotatable anode wheel 2 the shaft 3 upon which the anode rotates being located in a bearing 4 in the side wall 5 and passing through a bearing 6 in the side wall 7 to a rotary drive 8. Power is transmitted in a conventional manner to the drive 8 from an electric motor (not shown). The shaft 3 contains channels for the circulation of cooling water through cavities 9 in the anode. The side wall 7 has a demountable vacuum seal 10 to the envelope 1 so that the anode can be removed and replaced.

An electron gun 11A is mounted in a tubular neck 11 whose axis extends radially from the envelope 1 and in the median radial plane of the anode 2; the electron gun 11a is of conventional form and its details are therefore not shown in the drawings. In operation the electron gun produces a beam having the preferred rectangular section which is focused at the cylindrical surface of the anode 2 and a deflection coil 12 is mounted on the neck 11 to enable the beam to be deflected across the cylindrical surface of the anode 2 parallel to the axis of rotation. The electron gun preferably includes an ion trap with an adjusting magnet 13 mounted on the neck 11.

On the side wall 5 of the envelope 1 a port 14 is provided for an X-ray collimator (not shown) to be mounted so that its axis may be directed towards the position of the focal point on the anode surface and inclined, in the radial plane containing the axis of scan of the focal point at the surface of the stationary anode, at about 4° to that axis.

Figure 2:
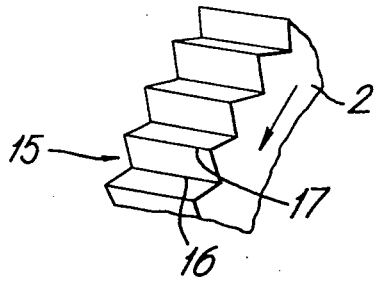
FIG. 2 is a diagrammatic representation of a portion of a rotatable anode used in a tube according to the invention.

FIG. 2 represents diagrammatically a peripheral portion of the anode 2. The anode 2 is a cylindrical copper block the superficial cylindrical profile of which is uniformly serrated by a continuous formation of transverse channels 15 of V-section. The angle of the V-section is suitably but not essentially about 90°, the pitch of the channel pattern being then twice the radial depth of each channel 15 which is conveniently 1 mm. The transverse dimension of each channel 15 (which is the peripheral thickness of the anode 2) is made not less than fifteen times the radial depth of each channel 15.

The manner of use of an X-ray source employing such a profiled anode may now be made clear. As has been explained it is established practice in X-ray analysis and has been provided in the X-ray tube of FIG. 1, that the collimating axis should be inclined at about 4° to the target surface. Thus for the structure as described this axis will at any instant lie along the particular channel 15, in which the focal spot of the electron beam appears and will be inclined at about 4° in a radial plane to a transverse element of the surface. Considering an angle slightly less than 4° which may be taken as $\tan^{-1} 1/15$, if a focal spot initially on the collimation axis is scanned towards the collimator along the trough 16 of a channel 15 of the stationary anode 2 over a distance of 15 mm it will appear in the collimator to have moved 1 mm from the collimation axis. If, alternatively, as the spot is scanned from the same starting point the anode 2 is rotated at such a rate that at the end of the 15 mm scan the spot lies exactly at the crest 17 of the same channel 15, it will appear in the collimator not to have moved from the axis; and provided the channel surface, the scanning waveform and the rate of rotation are uniform the spot will appear stationary at all parts of the scanning period. The apparent size of the spot will in each case be reduced from, for example, a rectangle $0.1 \times 1.5$ mm to a square $0.1 \times 0.1$ mm.

The conditions for synchronism to be maintained between the scan and the rate of rotation may be expressed generally in the form $1/f = p/u$ where $f$ is the frequency of a symmetrical triangular scanning waveform, $p$ is the pitch of the channel pattern and $u$ is the peripheral velocity of the anode, the radial depth of the channel, the scan amplitude and the inclination of the collimator axis remaining constant. For a channel pattern in which $p = 0.2$ cm. and for a rotational rate for the anode of 6000 rpm the required scan frequency is 1.57KHz times the number of centimeters in the diameter of the anode. The frequency range is therefore convenient for an electromagnetic generator for anodes of practical interest in the range of a few tens of centimeters in diameter.

Figure 3:
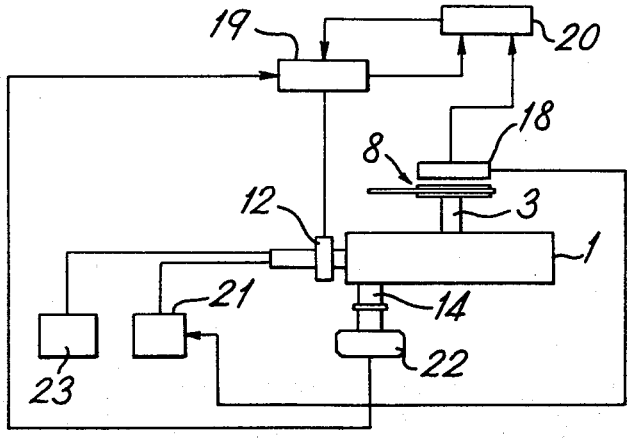
FIG. 3 is a schematic diagram of an X-ray generator incorporating the invention.

The schematic circuit arrangement of FIG. 3 indicates the essential control features of the system. A sensor 18 monitors rotation of the anode shaft 3, its output being converted to represent the scanning frequency appropriate to the particular anode design and speed for comparison with the output of a scanning waveform generator 19. A difference signal may be derived from the comparator 20 to correct either the generator frequency or the speed of the rotary drive. A second output from the sensor 18 is applied to cut off the high-voltage power supply 21 to the electron gun in the event of a serious reduction in anode speed.

The rotational position of the anode serration pattern is monitored by optical means, which may be incorporated in the X-ray camera 22 or may be mounted at a separately provided port, and an indexing signal is derived to be applied to the scan generator 19 for control of the phase of the scan waveform. The width of scan and the electron gun low-voltage supply 23 are manually adjusted and do not require continuous control.

The desired geometrical result of the apparently stationary source has been described in terms of a symmetrical triangular scanning waveform and a V-shaped channel section but it may be achieved with other appropriate combinations of conditions. For example it may be advantageous to employ a more nearly sinusoidal waveform and a correspondingly radiused channel section to avoid the possibility of excessive local heating at the point of scan reversal on the crest of a channel.

The design of anode structure is adaptable to the conditions of use in respect particularly of the serration profile, within the design criteria described, and of the cooling arrangement. For example, at low speeds of rotation water circulation can be maintained internally between the centre and the periphery of a largely hollow anode; at higher speeds water-cooling is restricted to the axial area and a largely solid anode is suitable. In this case the mechanical stresses may be reduced by tapering the thickness towards the periphery and by the use of lightweight materials such as aluminium alloys. An outer rim of copper or other material chosen for its thermal, X-ray emission or other properties would then be applied.

Difficulty has been experienced in maintaining good thermal contact between a main cylinder and a rim of different material when centrifugal stress is exerted on the mechanical joint and it is contemplated that in this respect it would be advantageous to use fusion-sprayed metal to form the rim. The channel pattern required according to the invention could in this case be applied by subsequent machining or by suitable programming of the spray process.

I claim:

1. A rotating-anode X-ray tube comprising:

an anode in the form of a generally circular wheel having a rim of uniformly serrated profile, the width of said rim being large relative to the depth of the serrations;

means mounting said anode for rotation about the axis of said wheel;

means for bombarding said rim with an electron beam directed transversely to said axis so as to impinge on a spot which has dimensions small relative to the width of said rim and is movable across the width of said rim by deflection of said beam; and an envelope surrounding said anode and said bombarding means and provided with a port which will permit the emergence from said envelope, in a direction nearly parallel to said axis, of X-rays generated by the impingement of said electron beam on said spot.

2. A rotating-anode X-ray tube according to claim 1 wherein the serration profile of the anode rim is of symmetrical V-form.

3. A rotating-anode X-ray tube according to claim 1 wherein the serration profile of the anode rim is substantially sinusoidal.

4. An X-ray generator comprising:

a rotating-anode X-ray tube having an anode in the form of a generally circular wheel having a rim of uniformly serrated profile, the width of said rim being large relative to the depth of the serrations, means mounting said anode for rotation about the axis of said wheel, means for bombarding said rim with an electron beam directed transversely to said axis so as to impinge on a spot which has dimensions small relative to the width of said rim and is movable across the width of said rim by deflection of said beam, and an envelope surrounding said anode and said bombarding means and provided with a port which will permit the emergence from said envelope, in a direction nearly parallel to said axis, of x-rays generated by the impingement of said electron beam on said spot;

drive means for rotating the anode of said tube; means for operating the bombarding means of said tube; means for cyclically deflecting the electron beam generated by the operation of said bombarding means to cause the spot on which said beam impinges to scan to and fro across the rim of said anode with a scanning waveform conforming generally to the serration profile of said rim; and means for synchronising the operation of said drive means and said deflecting means so that the frequency of the scanning of said spot is equal to the rotational frequency of said anode multiplied by the number of serrations on said rim and so that said spot will lie respectively on the crests and in the troughs of said serration profile when it is respectively nearest to and furthest from the port of said tube;

whereby said spot will appear substantially stationary when viewed through said port in a direction lying in a plane passing through the axis of rotation of said anode and making with said axis an angle whose tangent is equal to the ratio of the depth of said serrations to the length of the scan of said spot across said rim.

5. An X-ray generator according to claim 4 wherein the serration profile of the anode rim is of symmetrical V-form.

6. An X-ray generator according to claim 4 wherein the serration profile of the anode rim is substantially sinusoidal.

* * * * *